US007878585B2

(12) United States Patent
Salisbury

(10) Patent No.: US 7,878,585 B2
(45) Date of Patent: Feb. 1, 2011

(54) FOLDABLE CHAIR WITH FORCED AIR COOLING SYSTEM

(76) Inventor: Keith B. Salisbury, 346 High Point Cir. North, Bourbonnais, IL (US) 60914

( * ) Notice: Subject to any disclaimer, the term of this patent is extended or adjusted under 35 U.S.C. 154(b) by 111 days.

(21) Appl. No.: 12/346,493

(22) Filed: Dec. 30, 2008

(65) Prior Publication Data

US 2010/0164256 A1 Jul. 1, 2010

(51) Int. Cl.
*A47C 7/72* (2006.01)
*A47C 4/28* (2006.01)

(52) U.S. Cl. ..... 297/180.14; 297/45

(58) Field of Classification Search ..... 297/217.3, 297/45, 180.1, 180.13, 180.14, 180.07, 188.04, 297/188.2, 188.08, 228.12, 188.06
See application file for complete search history.

(56) References Cited

U.S. PATENT DOCUMENTS

| | | | | |
|---|---|---|---|---|
| 5,507,548 | A * | 4/1996 | Marhefka | 297/45 |
| 5,692,952 | A * | 12/1997 | Chih-Hung | 454/120 |
| 6,848,746 | B2 * | 2/2005 | Gentry | 297/380 |
| 7,161,253 | B2 * | 1/2007 | Sodemann et al. | 290/1 A |
| 2007/0187998 | A1 * | 8/2007 | Chen | 297/45 |

* cited by examiner

*Primary Examiner*—Milton Nelson, Jr.
(74) *Attorney, Agent, or Firm*—Davis M. Chin, Jr.; Davis Chin

(57) ABSTRACT

A foldable chair, which includes a forced air cooling system. The foldable chair includes a frame member. A flexible seat, which includes a meshed back rest suspends from the frame member. A fan bag, which has a pocket, is attached to the meshed back rest of the flexible seat. A fan is located at the bottom of the fan bag and is electrically disconnectable to a re-chargeable power source that is housed in a housing, which has an ON/OFF toggle switch so as to supply power to the fan.

8 Claims, 5 Drawing Sheets

FOLDABLE CHAIR WITH FORCED AIR COOLING SYSTEM

BACKGROUND OF THE INVENTION

1. Field of the Invention

This invention relates generally to a foldable chair, and more particularly, the present invention relates to a readily foldable chair having a forced air cooling system.

2. Description of the Prior Art

As an alternative to being indoors, people all over the world have enjoyed spending their free time at outdoor events. Particularly in America, football has been an extremely popular outdoor sport to attend. In fact, many people no longer just attend the football game itself, but also arrive early to the surrounding parking lots of the stadiums to participate in, what has become known as, tailgating.

Tailgating typically involves grilling food, consuming beverages and socializing while standing around the back, or tail, of the parked cars in the parking lot until the football game begins. The popularity of tailgating in the past few decades has started to attract many families to the parking lots of college and professional stadiums alike as a great way to spend a weekend together outside even if they do not actually have tickets to the games. As people began spending more time tailgating, instead of just in the games, they also started spending more money on tailgating equipment like portable chairs so they could relax and be more comfortable during their tailgating experience.

Similar to the big football stadium tailgating crowds, many children's sports also attract a large number of outdoor spectators. Often times these spectators, however, are not afforded the pleasure of event seating while watching the games, as at the college and professional sports events, and are compelled to bring their own seating or chairs so as to watch the game in comfort.

For example, two of the most popular children's outdoor-sports in the past few years have been baseball and soccer. Baseball has long since been the national past time of Americans and with the more recent televised exposure of the Little League World Series, more kids have been encouraged to play baseball and in turn more parents have been going to their games, which has increased the need for more portable seating. Likewise, with Major League Soccer's recent acquisitions of world superstar players, more kids have been excited and enthused to play soccer, which again, has increased the need for more portable seating for the spectators.

The portable "lawn chair" of years past quickly evolved from the single-directionally (Y direction) foldable chair to a more compact foldable chair that folds in both the X and Y direction. As the demand for more portable seating increased the folding designs implemented to reduce the amount of space taken up by the folded chairs became less awkward and easier to use. Thus, these chairs are now more easily foldable and foldable in such a way as to minimize the amount of space needed when the chairs are packed away in the back of vehicles.

Keeping in mind that most children's outdoor-sports are during the summer months, and that the college and professional football seasons, as well as professional soccer, span the summer months too, the earlier designed portable chairs were slightly uncomfortable to sit in during the summer time because the back portions of an individual would be flush to the chair, accumulating perspiration between the chair and the individual's back. In order to maintain structural stability and provide ventilation to the individual's back, many designs implemented a meshed backrest to the foldable chairs. These designs, however, only provided passive air to the back of the individual.

Therefore, it should come as a surprise that a compact, foldable chair that includes a forced air cooling system has not been developed and constructed heretofore in the prior art so as to provide seating and cooling comfort to an individual who is out-of-doors during the hot summer months. Because a device like this is not found in the prior art, it is desirable to provide a foldable chair with a forced air cooling system to people for enjoying the outdoors in a relaxing and comfortably cooling fashion. It is also desirable that the foldable chair with a forced air cooling system be formed of a lightweight durable construction, be relatively easy to be transported, and be compact so as to be stored in a minimal amount of space.

A prior art search directed to the subject matter of this application in the U.S. Patent and Trademark Office revealed the following Letters Patent:

| |
|---|
| 4,141,585 |
| 5,372,402 |
| 5,382,075 |
| 5,403,065 |
| 5,692,952 |
| 6,626,488 |
| 6,629,724 |
| 6,676,207 |
| 6,786,273 |
| 6,840,576 |
| 7,070,231 |

For example, U.S. Pat. No. 4,141,585 to Blackman discloses a folding cooling lounge chair. The transportable chair has multiple folding sections which each has a porous end. A plurality of vents is located on each porous section for the purpose of permitting air flow to the exterior of the cooling chair. The chair includes a compartment, which powers the electric fan via a power switch.

Further, there is disclosed in U.S. Pat. No. 6,840,576 to Ekern et al. a ventilated seat pad assembly for use with a chair. A seat pad has an upper surface area which is formed of a porous spacer fabric material. The pad includes a tongue, which is coupled to a fan. The fan may be located in several different locations on the pad and is coupled to a power source.

Furthermore, the patent to Shih, U.S. Pat. No. 5,382,075, discloses a chair seat with a ventilation device. The ventilation device comprises a chair seat and an air-blowing unit. The ventilation device includes a slip-proof cover which is furnished with several vent ports to facilitate air circulation. The air-blowing unit includes a motor, a ventilation hose and a fan.

Finally, U.S. Pat. No. 6,676,207 to Rauh et al. discloses a system that can be used in conjunction with any seating applications where climate control is desirable. The system has a seat pad, which has an air-permeable surface area. Adjacent and beneath the surface area is a heating element. The system also includes a fan/blower for circulating the warm air throughout the system.

The remaining patents, listed above but not specifically discussed, are deemed to be only of general interest and show the state of the art in cooling chairs.

None of the prior art discussed above discloses a compact, foldable chair that includes a forced air cooling system with a re-chargeable power source that is enclosed within a housing, and which, is of a lightweight durable construction, affordable in cost, and is relatively easy to be transported and operated by the average user.

SUMMARY OF THE INVENTION

Accordingly, it is a general object of the present invention to provide a foldable chair that includes a forced air cooling system, which overcomes the disadvantages of the prior art chairs.

It is an object of the present invention to provide a foldable chair that includes a forced air cooling system, which is relatively simple and economical to manufacture and assemble.

It is another object of the present invention to provide a foldable chair that includes a cooling system with a re-chargeable power source that is enclosed within a housing, which is relatively easy to be transported and operated by the average user.

It is still another object of the present invention to provide a foldable chair that includes a cooling system with a re-chargeable power source that is enclosed within a housing, which is fabricated of a lightweight durable construction and is affordable in cost.

It is still another object of the present invention to provide a foldable chair which includes a chair frame, a flexible seat, and a fan bag securely affixed to the flexible seat for allowing forced air to be passed from the fan bag through the flexible seat via a battery operated fan.

In a preferred embodiment of the present invention, there is provided a foldable chair, which includes a cooling system. The foldable chair includes a set of four crossed legs, which are pivotally and slidably coupled to a pair of back legs and a pair of front legs, and a circular frame member. A flexible seat, which includes a meshed backrest suspends from the circular frame member. A fan bag, which has a pocket, is attached to the meshed backrest of the flexible seat. A fan is located at the bottom of the fan bag. A re-chargeable power source is contained within a housing and is electrically coupled to the fan. The housing has an ON/OFF toggle switch, so as to control power to the fan.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
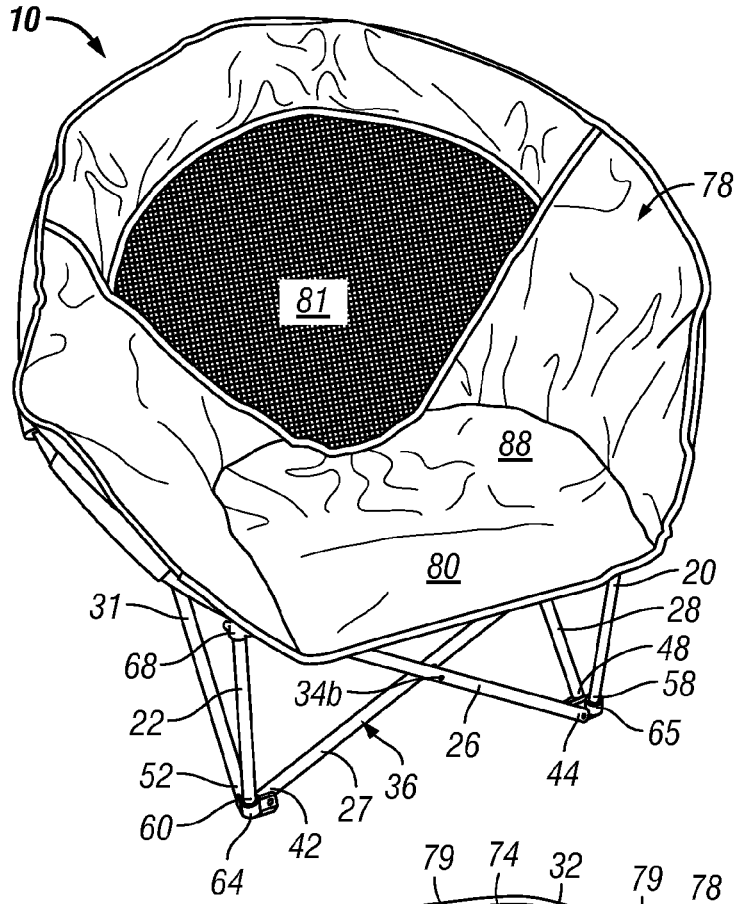
FIG. 1 is a perspective front view of a fully assembled foldable chair having a forced air cooling system with a re-chargeable power source that is enclosed within a housing, constructed in accordance with the principles of the present invention.

It is to be distinctly understood at the outset that the present invention shown in the drawings and described in detail in association with a compact, foldable chair that includes a forced air cooling system with a re-chargeable power source that is enclosed within a housing, is not intended to serve as a limitation upon the scope or teachings thereof, but is to be considered merely for the purpose of convenience of illustration of one example of its application.

Referring now in detail to the drawings, wherein like reference characters designate like or corresponding parts throughout the several views, a foldable chair that includes a forced air cooling system with a re-chargeable power source that is enclosed within a housing is illustrated in FIGS. 1 through 8 in accordance with the principles of the present invention.

Figure 2:
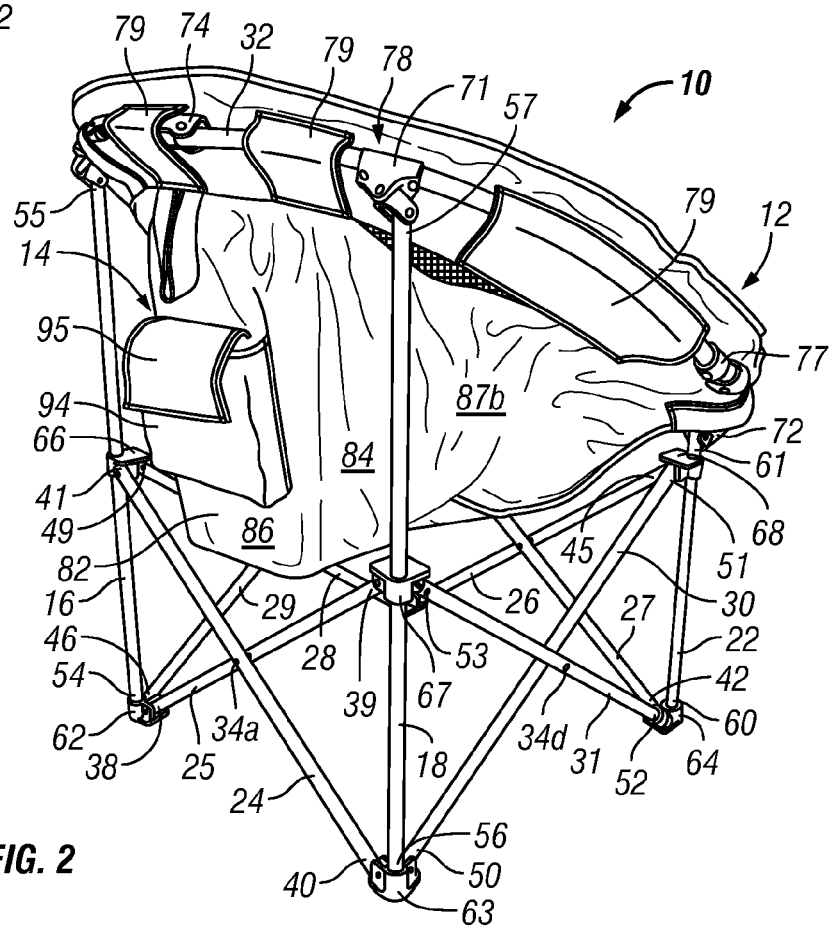
FIG. 2 is a perspective back view of the fully assembled foldable chair of FIG. 1 in accordance with the present invention.
Figure 3:
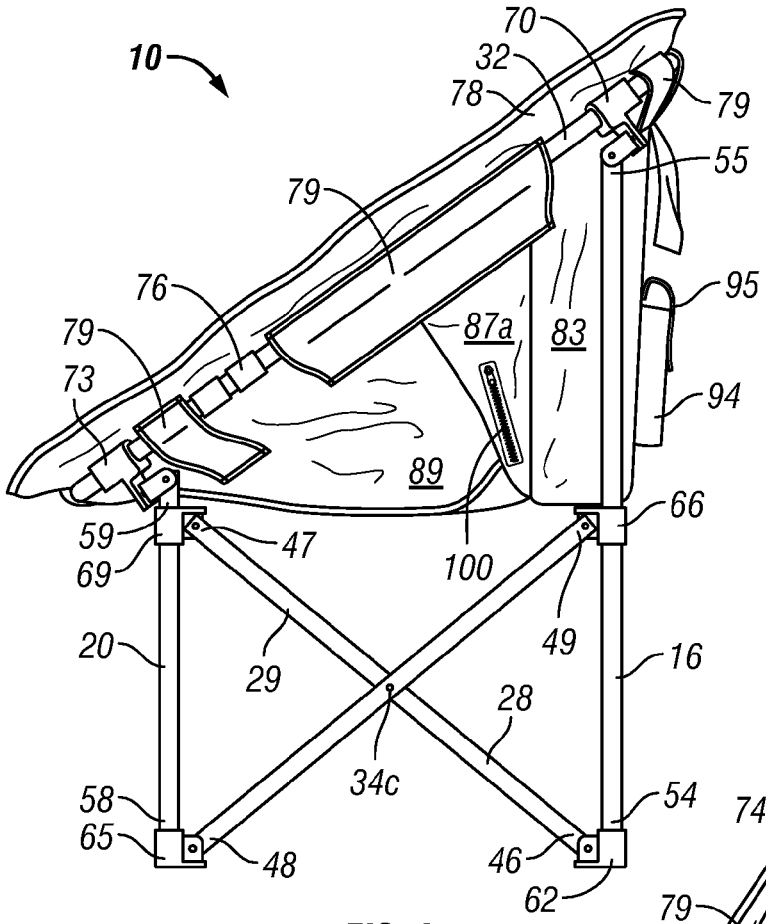
FIG. 3 is a perspective left side view of the fully assembled foldable chair of FIG. 2 in accordance with the present invention.

As best shown in FIGS. 1-3, the foldable chair 10 is defined by a chair assembly 12 and a forced air cooling system assembly 14. Particularly, the chair assembly 12 includes a left back leg 16, a right back leg 18, a left front leg 20 and a right front leg 22. The chair assembly 12 also includes a pair of back crossed legs 24,25, a pair of front crossed legs 26,27, a pair of left crossed legs 28,29, a pair of right crossed legs 30,31 and a circular frame member 32. Although the frame member 32 is described as having a circular shape for the best mode, it should be apparent to those skilled in the art that the frame member may be alternately formed of a substantially rectangular, oval, square or other suitable shape. The back crossed legs 24,25 are pivotally joined together at their approximate centers by a pivot pin 34*a*. Similarly, the respective legs of each pair of crossed legs 26,27, 28,29 and 30,31 are also pivotally joined together at their approximate centers by respective pivot pins 34*b*-34*d*.

The four pair of crossed legs 24,25, 26,27, 28,29, 30,31, left and right back legs 16,18, left and right front legs 20,22, and circular frame member 32 are all suitably coupled together so as to form chair frame 36, as best seen from FIG. 2. Further, all of the crossed legs 24-31; back legs 16,18; front legs 20,22 and frame member 32 are preferably fabricated from a lightweight durable material, such as aluminum, stainless steel, plastic or the like.

Specifically, a lower back left connector 62 is affixed to the lower end 54 of left back leg 16 and is also pivotally joined to the lower end 38 of back crossed leg 25 and to the lower end 46 of left crossed leg 29. Similarly, a lower back right connector 63 is affixed to the lower end 56 of right back leg 18 and is also pivotally joined to the lower end 40 of back crossed leg 24 and to the lower end 50 of right crossed leg 30. Further, a lower front right connector 64 is affixed to the lower end 60 of right front leg 22 and is also pivotally joined to the lower end 52 of right crossed leg 31 and to the lower end 42 of front crossed leg 27. Finally, a lower front left connector 65 is affixed to the lower end 58 of left front leg 20 and is also pivotally joined to the lower end 44 of front crossed leg 26 and to the lower end 48 of left crossed leg 28.

The chair frame 36 is further structurally defined with a slidable upper back left connector 66, which is designed to be axially slidable along the approximate center distance of left back leg 16, and which is also pivotally joined to the upper end 49 of left crossed leg 28 and to the upper end 41 of back crossed leg 24. In a like manner, a slidable upper back right connector 67, which is designed to be axially slidable along the approximate center distance of right back leg 18, and which is also pivotally joined to the upper end 39 of back crossed leg 25 and to the upper end 53 of right crossed leg 31. In addition, a slidable upper front right connector 68, which is designed to be axially slidable along right front leg 22, and which is also pivotally joined to the upper end 51 of right crossed leg 30 and to the upper end 45 of front crossed leg 26. Furthermore, a slidable upper front left connector 69, which is designed to be axially slidable along left front leg 20, and which is also pivotally joined to the upper end (not shown) of front crossed leg 27 and to the upper end 47 of left crossed leg 29.

Moving along, a curved back left connector 70 is slidably engaged with the edge of the circular frame member 32 and is located at a position, which, when the chair 10 is unfolded and viewed from the back, corresponds to a location approximately between the 10 o'clock and 11 o'clock positions of a standard faced clock. The curved back left connector 70 is also pivotally joined to the upper end 55 of left back leg 16. Similarly, a curved back right connector 71 is also slidably engaged with the edge of the circular frame member 32 except the connector 71 is located at a position, which, when the chair 10 is unfolded and viewed from the front, corresponds to a location approximately between the 1 o'clock and 2 o'clock positions of a standard faced clock. The curve back right connector 71 is also pivotally joined to the upper end 57 of the right back leg 18.

In a similar fashion, a curved front right connector 72 is slidably engaged with the edge of the circular frame member 32 and is located at a position, which, when the chair 10 is unfolded and viewed from the back, corresponds to a location approximately between the 4 o'clock and 5 o'clock positions of a standard faced clock. The curved front right connector 72 is also pivotally joined to the upper end 61 of right front leg 22. A curved front left connector 73 is slidably engaged with the edge of the circular frame member 32 and is located at a position, which, when the chair 10 is unfolded and viewed from the front, corresponds to a location approximately between the 7 o'clock and 8 o'clock positions of a standard faced clock.

Additionally, a top hinge 74 is located approximately at the top center edge of the circular frame member 32 and a bottom hinge 75 is located approximately at the bottom center edge of the circular frame member 32. Further, a left hinge 76 is located approximately at the left edge of the circular frame member 32 at a position that is disposed substantially between the curved back left connector 70 and the curved front left connector 73. Similarly on the other side of the circular frame member 32, a right hinge 77 is located at the right edge of the circular frame member 32 at a position that is substantially between the curved back right connector 71 and the curved front right connector 72.

A seat 78 is preferably made of a durable, synthetic, flexible material. The seat 78 has a substantially concave contour and is suspended from the circular frame member 32 by a series of sleeves 79 (four of which are shown in FIG. 2), which are positioned along the non-concave edge of the seat 78, so that the concave side 88 of the seat 78 hangs through the circular frame member 32 and downward toward the ground. The seat 78 is defined by a seat rest portion 80 and a meshed backrest portion 81.

Figure 7:
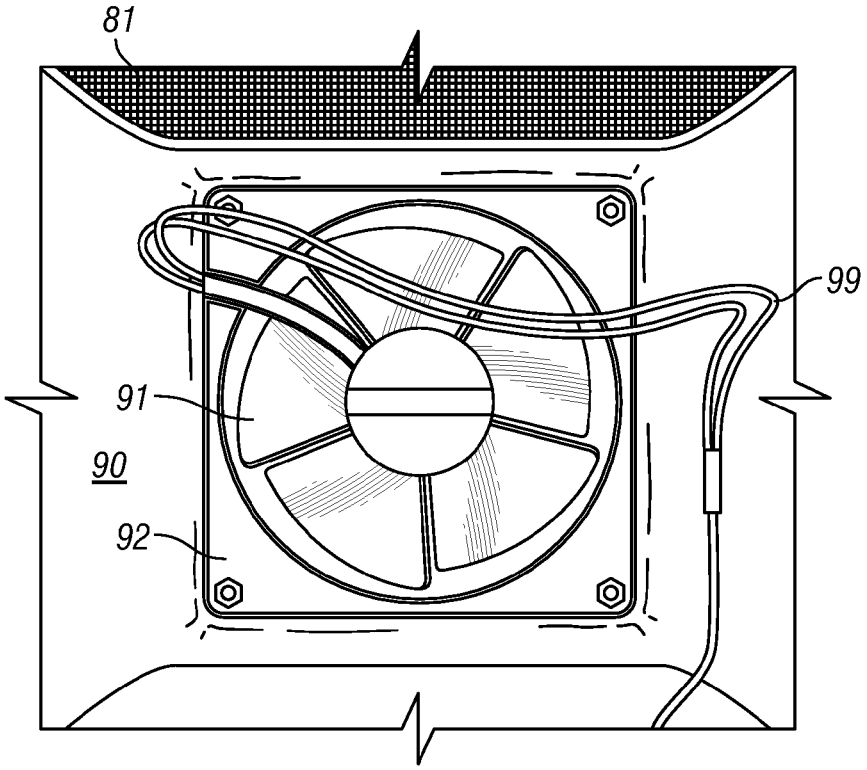
FIG. 7 is a perspective view of the inside of the fan bag of the fully assembled foldable chair of FIG. 2.

A substantially rectangular fan bag 82 is comprised of a left side 83, a right side 84, a bottom side 85, a power source side 86 and attachment sides 87*a* and 87*b*. Attachment sides 87*a* and 87*b* of the fan bag 82 are joined to the substantially convex side 89 of seat 78 so that attachment sides 87*a* and 87*b* fully seal the meshed backrest portion 81. An enclosure 90 is thus formed from the meshed backrest portion 81, the left side 83, the right side 84, the bottom side 85 and the power source side 86. The meshed backrest portion 81 of the seat 78 is fully visible within the enclosure 90, as shown in FIG. 7.

Further, as shown in FIG. 3, a side zipper 100 is located on attachment side 87*a* of the fan bag 82. The side zipper 100 allows a user to gain easy access to the enclosure 90 and the fan 91.

Centrally located on the bottom side 85 of the fan bag 82 is a compact battery operated fan 91. The fan 91 is orientated so that an inner side 92 is exposed within the enclosure 90, as shown in FIG. 7, and an outer side 93, which is covered by a protective metal guard 93*a* (shown in an exploded view in FIG. 6), is exposed to the ambient air. Alternately, a protective mesh guard, or the like, could be used instead of the metal guard 93*a* in order to protect the user from the fan 91.

Figure 5:
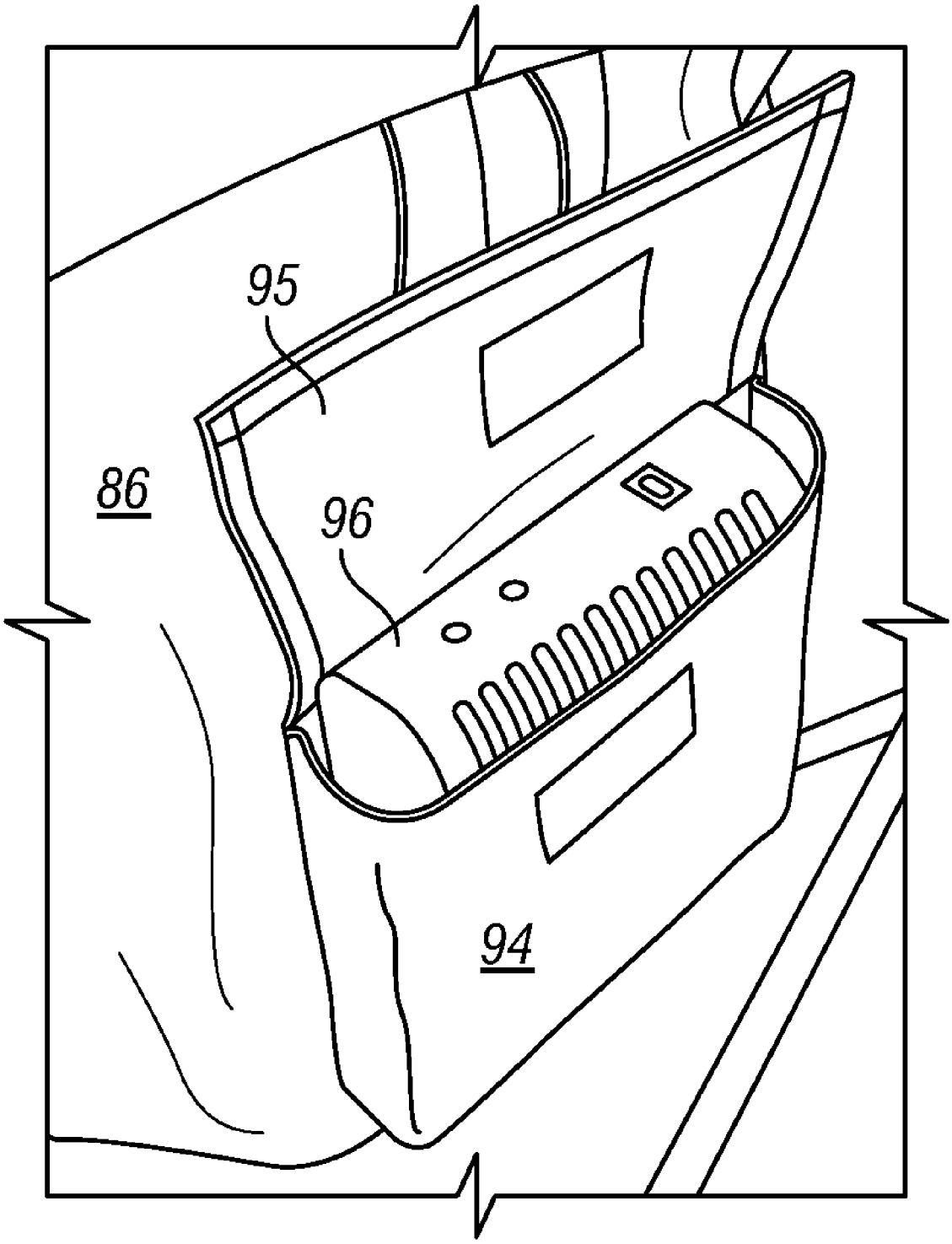
FIG. 5 is an enlarged perspective view of the battery pocket of FIG. 2, with the flap depicted in an open position.
Figure 6:
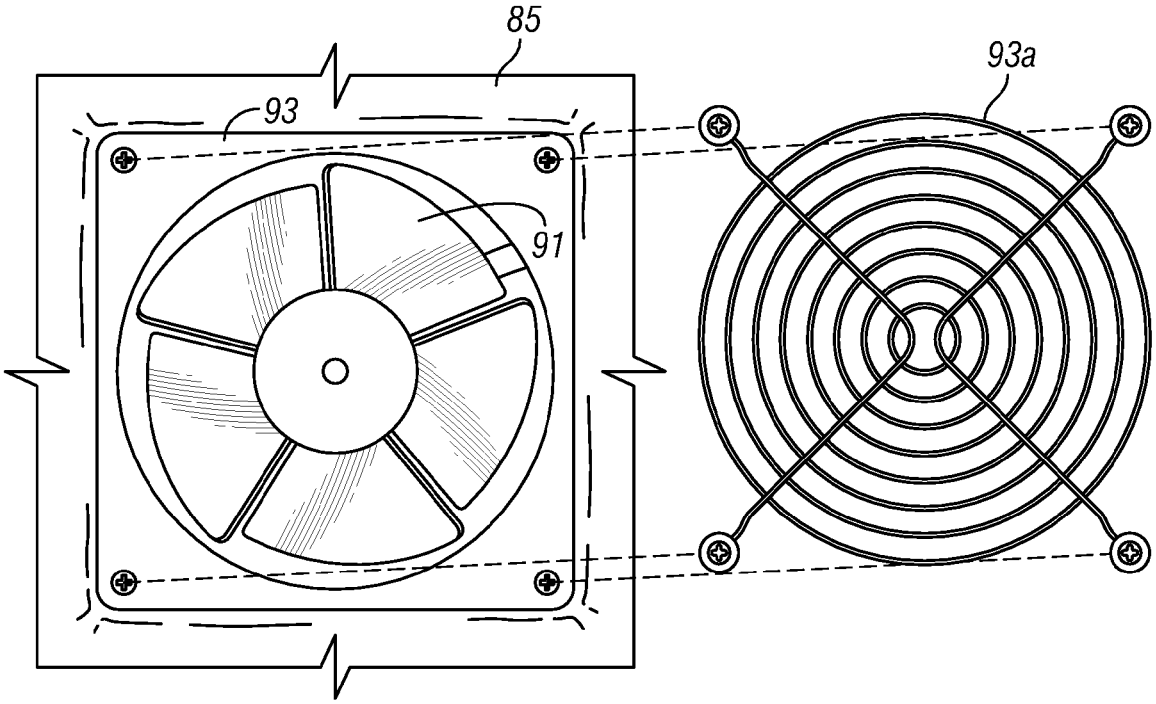
FIG. 6 is a bottom perspective view of the fan bag of the fully assembled foldable chair of FIG. 2.

As shown in FIGS. 2 and 5, power source pocket 94 is attached to the outer side of the power source side 86 of the fan bag 82. The power source pocket 94 has a top flap 95. In the closed position, the top flap 95 is detachably secured to the outside of pocket 94 with Velcro. However, it should be clearly understood that any other securing means such as snaps, buttons or the like may also be used in the alternative.

Figure 8:
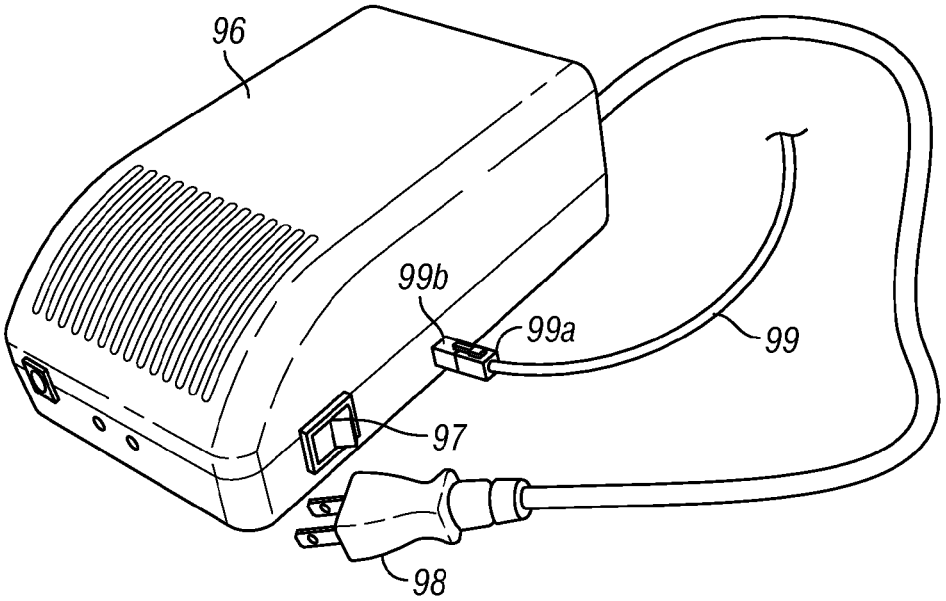
FIG. 8 is a perspective view of a re-chargeable power source contained in a housing, for use with the fully assembled foldable chair of the present invention in FIG. 2.

A rechargeable power source and housing 96 is provided with an ON/OFF toggle switch 97 mounted thereon as shown in FIG. 8. Also mounted on the rechargeable power source and housing 96 is a female connector 99*b*. The rechargeable power source and housing 96 includes a power source such as a 12-volt DC re-chargeable battery source (not shown) and is placed into the power source pocket 94 during use. Alternately, the battery source could also be formed of a plurality of D-sized cell batteries or any other transportable power source. The ON/OFF toggle switch 97 is electrically coupled between the power source and the female connector 99*b* in order to control the supply of power to the fan 91.

The fan 91 is electrically coupled to one end of wires 99. The opposite end of wires 99 are fed through an opening (not shown), which is located near the top of the power source side 86 and continues through into the power source pocket 94. The opposite end of wires 99 has a male connector 99*a* that is disconnectable to a female connector 99*b*, which, as mentioned before, is mounted on rechargeable power source and housing 96. When not in use the rechargeable power source and housing 96 is easily disconnected from the fan 91 by disconnecting connector 99*a* from connector 99*b* and then can easily be removed from the pocket 94. Once the rechargeable power source and housing 96 is removed from the pocket 94, it can be re-charged by plugging a male plug 98 of the power source, into a wall outlet.

After charging the power source, the male plug 98 of the power source is disconnected from the wall outlet. Then, the male connector 99*a* of the wires 99 is connected to the female connector socket 99*b* of the rechargeable power source and housing 96. The rechargeable power source and housing 96 is then placed into pocket 94 for convenient storage during use.

Figure 4:
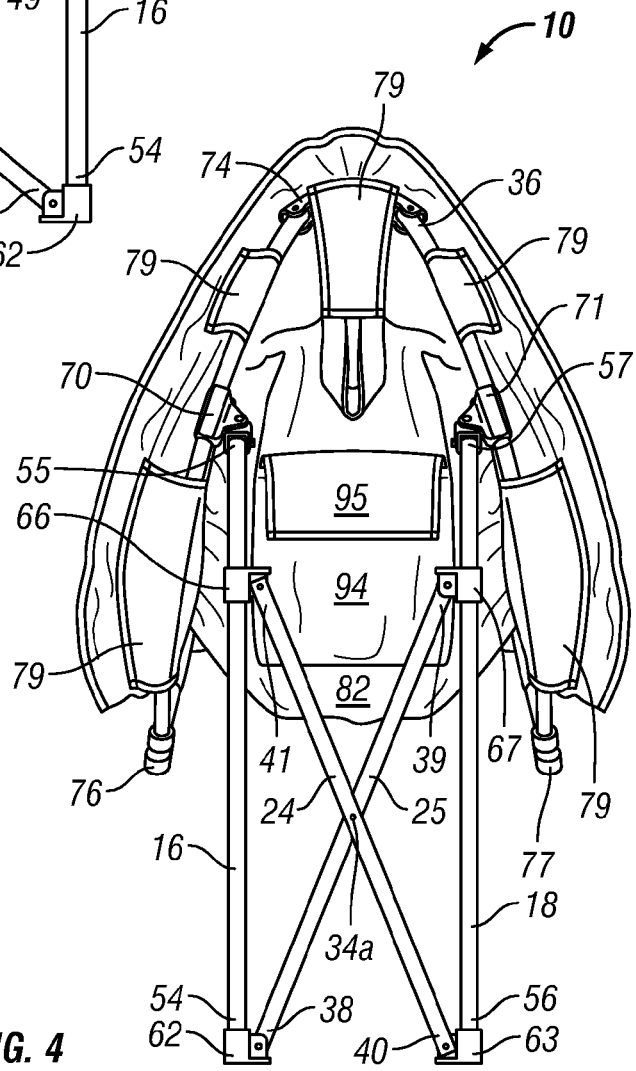
FIG. 4 is a back view of the fully assembled foldable chair of FIG. 1 shown in a folded position, according to the present invention.

In operation, the folded foldable chair 10, as shown in FIG. 4, is easily unfolded, to the unfolded position illustrated in FIGS. 1 through 3, by simultaneously causing the upper connectors 66-69 to move downwardly along their respective legs 16-22, which in turn, causes crossed legs 24-31 to pivot into their unfolded positions; curved connectors 70-73 slide along the edge of circular frame member 32 into their unfolded position; and hinges 74-77 to move to their unfolded positions, which allows flexible seat 78, with fan bag 82 and power source pocket 94, to unfold downwardly into the circular frame member 32 and toward the ground.

Once the foldable chair 10 is in its unfolded position, the top flap 95 can then be opened to expose access to the switch 97 of the rechargeable power source and housing 96. The switch 97 can then be switched to its ON-position causing the fan 91 to draw ambient air into the fan bag 82 and through the meshed backrest portion 81 of seat 78 creating a cooling refreshing effect for an individual who is seated in the chair 10.

The foldable chair, in its folded condition of FIG. 4, is relatively easy to be transported from place to place or placed in storage by the average use. The foldable chair is further made of a durable, lightweight construction so as to provide a long life and is compact so as to be easily carried around.

From the foregoing detailed description, it can thus be seen that the present invention provides a compact foldable chair with a forced air cooling system with a re-chargeable power source that is enclosed within a housing, and which, is of a lightweight durable construction, is relatively easy to be transported and is simple to operate by the average user. The foldable chair includes a chair frame, a flexible seat, and a fan bag securely affixed to the flexible seat for allowing forced air to be passed from the fan bag through the flexible seat. A re-chargeable power source is used to power a fan disposed in the fan bag.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A foldable chair, comprising:

a foldable chair frame being formed of a frame member, first and second back legs, first and second front legs, a pair of front crossed legs, a pair of back crossed legs, a pair of left crossed legs and a pair of right crossed legs;

said pair of back crossed legs being pivotally and slidably engaged with said first and second back legs;

said pair of right crossed legs being pivotally and slidably engaged with said second back leg and said first front leg;

said pair of front crossed legs being pivotally and slidably engaged with said first and second front legs;

said pair of left crossed legs being pivotally and slidably engaged with said second front leg and said first back leg;

said frame member being pivotally and slidably engaged with said first and second back legs and with said first and second front legs;

a flexible seat being engaged with said frame member so that said flexible seat suspends downwardly toward the ground and through said frame member;

a fan bag being securely affixed to said flexible seat so that forced air is passable from said fan bag through said flexible seat;

a fan being securely affixed to said fan bag;

a pocket being affixed to said fan bag; and a power source being electrically disconnectable from said fan, said power source being removably disposed within said pocket.

2. A foldable chair as claimed in claim 1, wherein said power source is electrically disconnectable from said fan so as to recharge said power source via an AC wall outlet.

3. A foldable chair as claimed in claim 1, wherein said pocket has a top flap, which is capable of flipping open so as to permit access to said pocket.

4. A foldable chair as claimed in claim 1, wherein said power source is a 12-volt DC re-chargeable power source.

5. A foldable chair as claimed in claim 1, wherein said fan is affixed to the bottom of said fan bag.

6. A foldable chair as claimed in claim 1, further comprising a protective metal guard which is affixed to the bottom of said fan bag.

7. A foldable chair as claimed in claim 1, wherein said frame member is of a substantially circular shape.

8. A foldable chair as claimed in claim 1, wherein said flexible seat has a meshed backrest.

* * * * *